United States Patent [19]

Dickens et al.

[11] Patent Number: 4,849,589

[45] Date of Patent: Jul. 18, 1989

[54] CONTACT ASSEMBLY FOR A CIRCUIT BREAKER

[75] Inventors: James W. Dickens; Clark L. Oster, both of Grand Rapids, Iowa

[73] Assignee: Square D Company, Palatine, Ill.

[21] Appl. No.: 266,262

[22] Filed: Oct. 26, 1988

Related U.S. Application Data

[63] Continuation of Ser. No. 91,154, Aug. 31, 1987, abandoned, which is a continuation of Ser. No. 720,210, Apr. 5, 1985, abandoned.

[51] Int. Cl.[4] ..... H01H 9/38

[52] U.S. Cl. ..... 200/146 R; 200/251

[58] Field of Search ..... 200/146 R, 147 R, 153 G, 200/250, 251; 335/201

[56] References Cited

U.S. PATENT DOCUMENTS 3,134,878 5/1964 Jencks ..... 200/250
3,198,924 8/1965 Brumfield et al. ..... 200/251
3,263,051 7/1966 Gauthier et al. ..... 200/153 G
3,525,837 8/1970 Leonard ..... 200/286
3,662,134 5/1972 Cellerini ..... 200/146 R

*Primary Examiner*—William A. Cuchlinski, Jr.
*Assistant Examiner*—W. Morris Worth
*Attorney, Agent, or Firm*—Richard T. Guttman; Jose W. Jimenez; Thomas B. Lindgren

[57] ABSTRACT

Apparatus for simultaneously applying two independent forces to the contact blades of a movable contact assembly. The contact assembly has three contact blades joined at the base. The circuit breaker mechanism exerts a closing force through a blade carrier to the center blade which in turn exerts a closing force on the outer main blades. To increase the contact force on the outside main blade contacts without increasing the contact force of the center blade contact and without changing the relative distances between the blade carrier and the main blade contacts and center blade contacts, a compression spring is positioned between each main blade and the blade carrier.

2 Claims, 4 Drawing Sheets

CONTACT ASSEMBLY FOR A CIRCUIT BREAKER

This applicaton is a continuation of application Ser. No. 091,154, filed on Aug. 31, 1987, now abandoned, which is a continuation of application Ser. No. 720,210, filed on Apr. 5, 1985, now abandoned.

FIELD OF THE INVENTION

This invention relates to contact assemblies for electric circuit breakers and is more particularly directed to a movable contact assembly having two or more contact fingers.

In the prior art, circuit breakers often utilized a contact structure employing a number of contact blades including outer main blades and center arcing blades. The main blades carry the majority of the current while the breaker is operating. When the breaker opens, an arc is drawn between the arcing blade and the stationary contact. To limit the arcing to the main blade and stationary contact, the contact force of the arcing blade must be greater than the contact force of the main blade. One way of establishing the relative contact forces is to make the contact force of the main blades dependent on and less than the contact force of the arcing blade.

Another requirement of the contact assembly is that the main blades have sufficient contact force to prevent their popping open while the breaker is withstanding a high current fault. Designing the contact assembly requires careful balancing of the different requirements of the contacts, including consideration of the limits of the associated operating mechanism. As the withstand level of the circuit breaker increases, the blow-open forces tending to force the contacts apart increase, requiring that the contact force of the main blades be increased without increasing the arcing blade contact force.

SUMMARY OF THE INVENTION

The preferred embodiment of the subject invention described herein includes a contact structure having a center arcing blade and a main blade on both sides of the arcing blade. The circuit breaker mechanism closes the circuit breaker contacts by exerting a downward force on the center arcing blade through the blade carrier. The arcing blade is connected to a T-bar that extends across the main blades, forcing them to move downwards simultaneously with the arcing blade. To obtain a greater contact force on the outer main blades, a compression spring is added between each main blade and the carrier. This improvement increases the contact force the main blades without affecting the contact force of the center arcing blade.

DESCRIPTION OF THE PREFERRED EMBODIMENT

The preferred embodiment of the subject invention is described herein as adapted for use with a circuit breaker described in U.S. Pat. Nos. 4,208,689 and 4,208,690, both entitled "Circuit Breaker Having an Electronic Fault Sensing and Trip Initiating Unit", issued to R. W. Dunham, et al on June 19, 1980 and to J. P. McGinnis, et al on June 17, 1980, respectively, but utilizing one mechanism per breaker as shown in U.S. Pat. No. 3,525,837 entitled "Movable Contact Structure for a Molded-Case Electric Breaker" issued to J. H. Leonard on Aug. 25, 1970. Those patents are incorporated by reference as if set forth fully herein. The invention may be utilized with many other types of contact assemblies present in a switch being manually opened and closed or having tripping capabilities.

Figure 1:
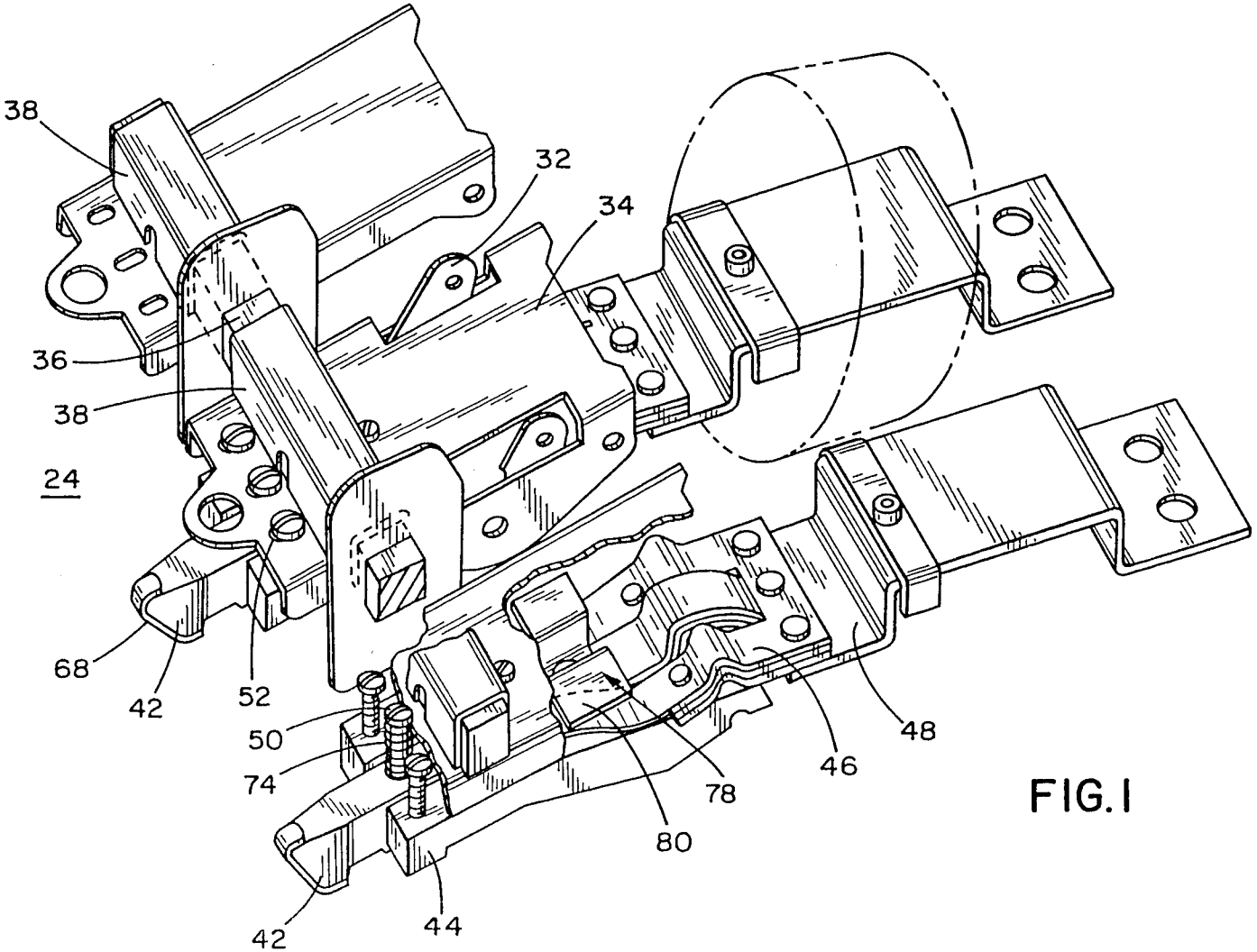
FIG. 1 is a perspective view of the preferred embodiment of the present invention showing a portion of the contact assembly with one blade carrier cut away.
Figure 2:
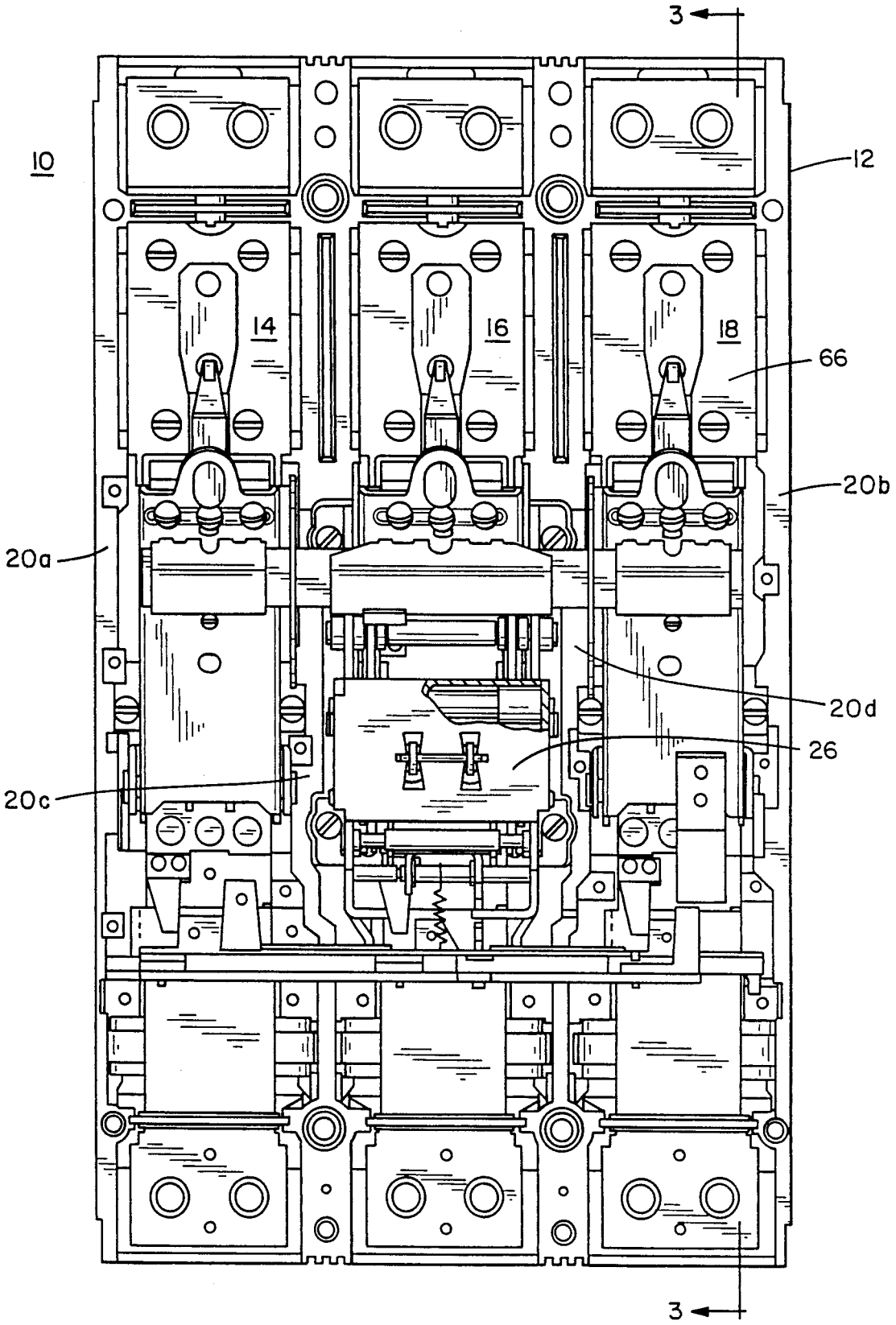
FIG. 2 is a top view of a circuit breaker utilizing the contact assembly of FIG. 1.
Figure 3:
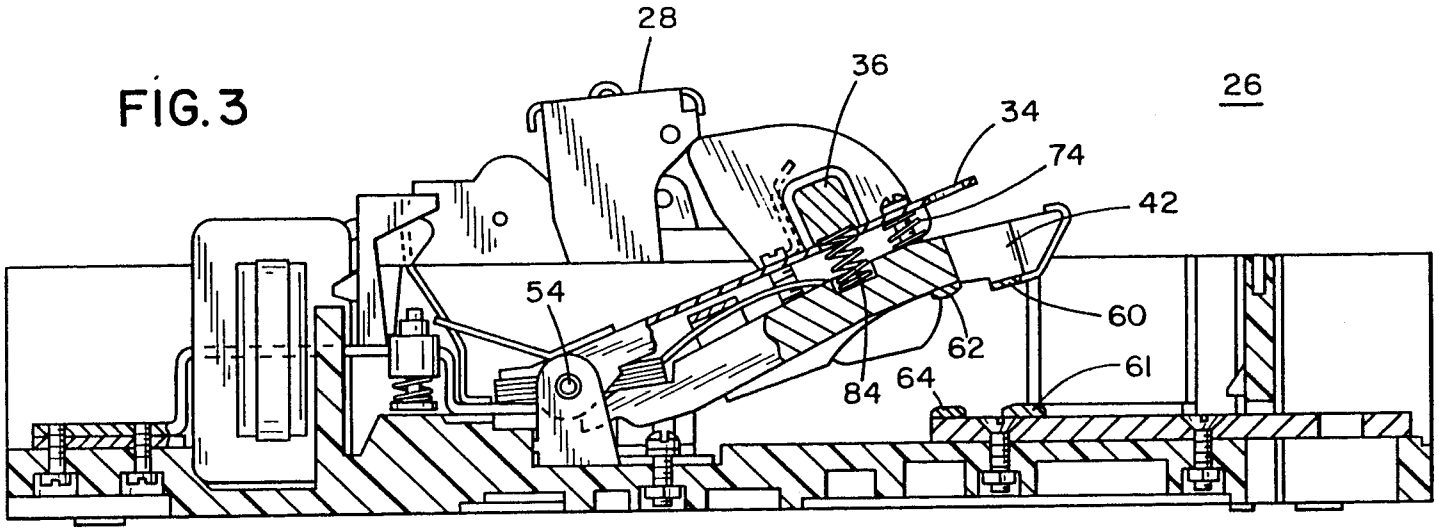
FIG. 3 is a sectional view of the circuit breaker of FIG. 2 taken along line 2—2 of FIG. 3 with a portion of the main blade removed.

A three pole circuit breaker 10 having a movable contact assembly in accordance with the present invention is shown in the Figures, in particular FIGS. 2 and 3. The circuit breaker has a molded base 12 and cover (not shown). The circuit breaker base is divided into three integral pole spaces 14, 16, and 18, one for each pole of the circuit breaker. The pole spaces 14, 16 and 18 are defined by parallel outer walls 20*a* and 20*b* and parallel inner walls 20*c* and 20*d*. Each pole of the breaker includes one movable contact assembly, indicated generally as numeral 24, and corresponding stationary contacts, as will be described later.

An overcenter spring operating mechanism indicated generally as 26, may be manually operated to open the circuit breaker contacts. The operating mechanism will also open the contacts upon the breaker sensing an overcurrent. The contacts are closed only by moving the operating handle 28 first to the open position then to the closed position. The operating mechanism is described in detail in the above-identified patents. It is sufficient to say herein that upon closing the breaker, the operating mechanism 26 exerts a downward force on the lower links 32.

Each lower link 32 is pivotally connected at its lower end to the blade carrier 34 of the center pole. A crossbar 36 is connected to the blade carrier 34 of all three poles by three channels 38, to cause all three blade carriers 34 to move simultaneously in response to the closing of the operating mechanism 26.

Each movable contact assembly 24 has an arcing blade 42 flanked on each side by a parallel main blade 44. Each blade 42 and 44 is connected at one end to a flexible metal strap 46, the other end of which is connected to a conductor 48 secured to the bottom of the base 12. The conductor 48 is connected to the other current carrying parts of the breaker not relevant to the invention described herein.

The arcing blade 42 and the two main blades 44 are connected to a blade carrier 34 by an overtravel adjustment screw 50 that passes through a hole 52 in the blade carrier and has its tip firmly planted in a respective arcing blade 42 or main blade 44. That end of each main blade 44 near the strap 46 is trapped between the blade carrier 34 and the bottom of the circuit breaker base 12 by the blade carrier 34 being mounted about a pivot 54 at that end at a distance close to the base bottom.

Figure 4:
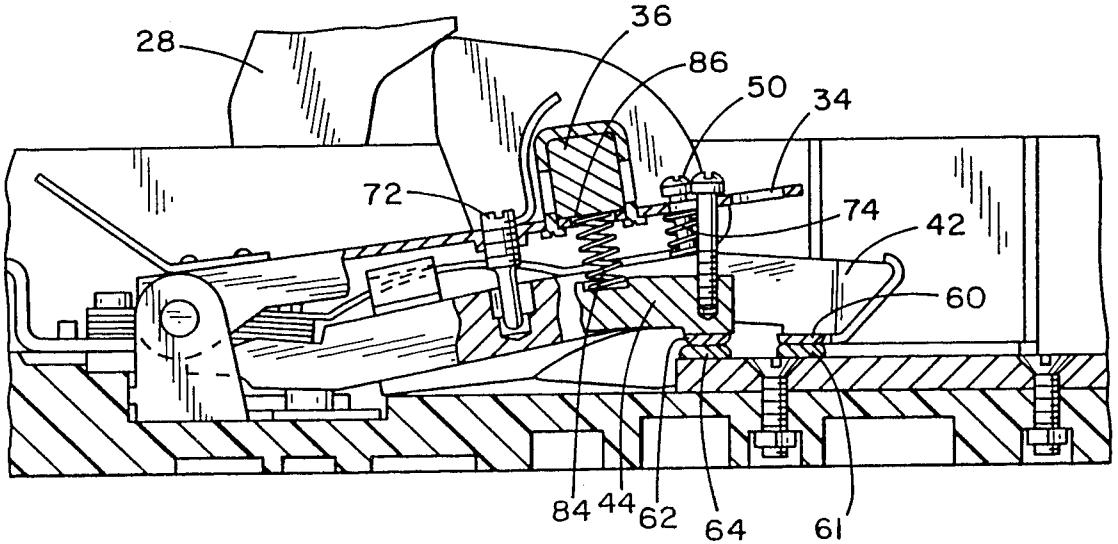
FIG. 4 is a sectional view of the blade assembly taken along line 2—2 of FIG. 3 with portions of the main blade and arcing blade removed.
Figure 5:
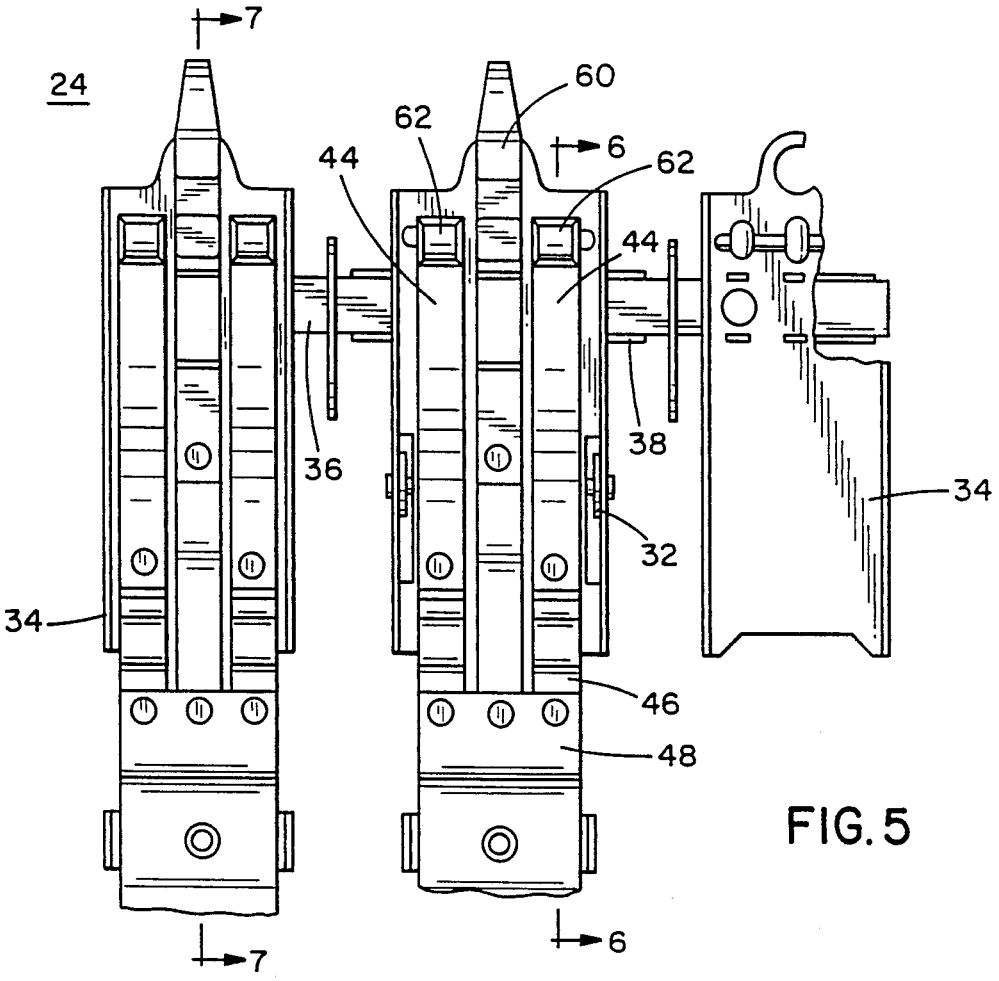
FIG. 5 is a bottom view of the blade assembly.
Figure 6:
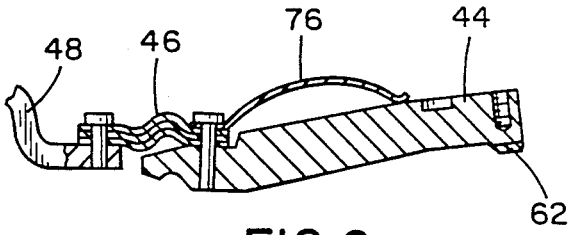
FIG. 6 is a side view of the main blade and flat spring.
Figure 7:
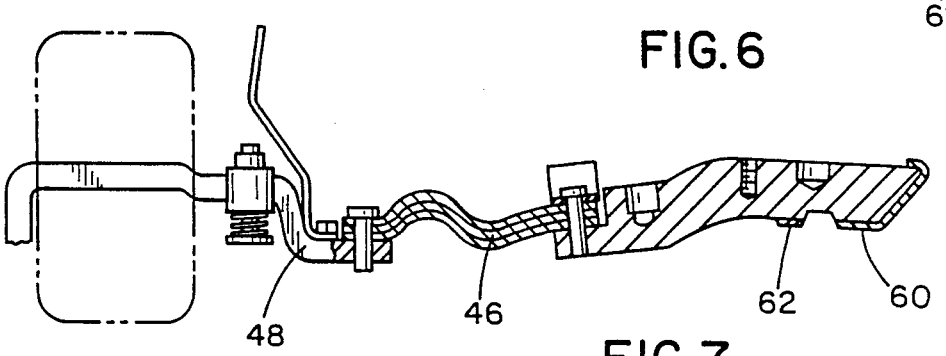
FIG. 7 is a side view of the arcing blade and connector.

Each main contact 62 (see FIG. 3) has an associated stationary main contact 64 fixed to the bottom of the circuit breaker base. The arcing blade 42 has a main contact 62 in addition to an arcing contact 60. The main blades 44 are designed to carry current only during the continuous operation of the breaker. The main contact 62 of the arcing blade 42 is in contact with an associated stationary main contact 64 when the breaker is closed. Upon operation of the breaker, the arcing blade 42 rocks so that its arcing contact 60 comes into contact with the stationary arcing contact 61 (see FIG. 4) remains there until after the main blade contacts 62 and 64 have parted. The relative timing of the opening of the main contacts 62 and arcing contact 60 is set by the overtravel adjustment screws 50 of each blade 42 and 44. This insures that the arc will be drawn between the arcing blade contact 60 and the stationary arcing contact 61 within the arc stack 66 (not shown). The arcing contact 60 and arcing horn 68 are provided with an arc resistant metal to accommodate extra wear due to arcing.

Each blade carrier 34 is connected to the respective arcing blade 42 by a holding screw 72. The arcing blade 42 is biased away from the blade carrier 34 by a coil spring 74 surrounding the overtravel adjustment screw 50. Closer to the contacts 60 and 62, an overtravel adjustment screw 50 establishes a minimum distance between each contact blade 42 and 44, respectively, and the blade carrier 34, as discussed above. The downward force exerted on the blade carrier 34 by the operating mechanism 26 is transferred to the arcing blade 42 via the holding screw 72 and also partially through the coil spring 74.

On top of each main blade 44 is flat spring 76 with middle portion some distance from the main blade 44. A T-bar 78 or member connected to the top of the arcing blade 42 has arms 80 that extend across the top of the flat springs 76. As the arcing blade 42 moves downward, the T-bar arms 80 press the flat spring 76 to force the main blades 44 downward. The main blades 44 being moving downward after the downward movement of the arcing blade 42.

Figure 8:
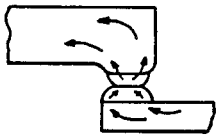
FIG. 8 is a diagram of current flowing through the circuit breaker contacts.

In the assembly described above, the contact force on the arcing contact 60 is approximately 25 pounds while the contact force on each main contact 62 is approximately 6 pounds. As shown in FIG. 8, the rounded contact surfaces creates a small blow apart loop between the moving and stationary contacts, both for the arcing contacts, 60 and 61, and the main contacts, 62 and 64. As the withstand level of the circuit breaker increases, the blow apart forces also increase, requiring a higher contact force to prevent the contacts from blowing open.

One solution to this problem is to increase the force of the operating mechanism 26 on the crossbar 36, via the blade carrier of the middle pole of the circuit breaker 10. This increases the respective contact forces for the arcing contact 60 and main contacts 62. However, the amount of force that may be applied to the crossbar 36 is limited by the energy available from the mechanism 26. The contact force of the arcing contact 60 is 25 pounds and is already sufficient to withstand the higher blow apart forces. Thus a design is needed that will increase the contact force of the main contacts 62 independently of the contact force of the arcing contact 60.

The present invention meets this need by supplying a compression spring 84 or actuator between the main blade 44 and blade carrier 34. One end of the compression spring 84 is positioned against the top of main blade 44 while the other end of the compression spring 84 passes through a hole 86 in the blade carrier 34 and rests against the crossbar 36. The compression spring 84 or actuated adds additional contact force to each main contact 62 independent of the force exerted upon the main contact 62 via the T-bar 78 and flat spring 76. In the preferred embodiment shown, the compression springs 84 add approximately 5–6 pounds of contact force to each main contact 44.

An additional benefit of the invention is that it reduces the amount of heat generated in the breaker by reducing the contact constriction resistance. The breaker will run cooler with the increased contact force.

While the invention has been shown and described with respect to the preferred embodiment, it will be understood by those skilled in the art that variations in form, construction and arrangement may be made therein without departing from the spirit and scope of the invention. All such variations are intended to be covered in the appended claims.

I claim:

1. Contact assembly for a switch having a molded base, said contact assembly having an open position and a closed position, said contact assembly being moved from the open position to the closed position upon the application of an external force to said contact assembly, said contact assembly comprising:

a first stationary contact mounted to the base;

a first movable contact having an open position and a closed position, said first movable contact being spaced a predetermined distance away from said first stationary contact in the open position, said first movable contact mating with said first stationary contact in the closed position, said first movable contact being pivotably movable towards the closed position upon receiving a downward force;

a second stationary contact mounted in said base;

a second movable contact having an open position and a closed position, said second movable contact being spaced a predetermined distance away from said second stationary contact in the open position, said second movable contact mating with said second stationary contact in the closed position, said second movable contact moving towards the closed position upon receiving a downward force such that mating force between the first movable and stationary contact is greater than mating force between the second movable and stationary contact;

a blade attached to each of said first and second movable contacts having one end pivotably mounted to said base and a second end carrying one of said first and second movable contacts;

a carrier positioned adjacent to one of said blades and pivotably mounted at one end near to the pivotal mount of said blades, said carrier being juxtapositioned above said blades and in contact with one of said blades for receiving the external force and in response exerting a downward force on said blades and first and second movable contacts;

a member connected between the blade having said first movable contact and the blade with said second movable contact, said member exerting a downward force on said blade with said seond movable contact upon said blade with said first movable contact moving towards said closed position; and an actuator means connected with said carrier and said blade with said second movable contact to exert an additional downward force on said second movable contact upon the carrier receiving the external downward force.

2. Contact assembly as in claim 1, wherein said actuator means comprises a resilient member.

* * * * *